US008289214B2

(12) United States Patent
Nogami

(10) Patent No.: US 8,289,214 B2
(45) Date of Patent: Oct. 16, 2012

(54) ARRAY ANTENNA

(75) Inventor: Hidekatsu Nogami, Kusatsu (JP)

(73) Assignee: Omron Corporation, Kyoto (JP)

( * ) Notice: Subject to any disclaimer, the term of this patent is extended or adjusted under 35 U.S.C. 154(b) by 68 days.

(21) Appl. No.: 12/451,478

(22) PCT Filed: Mar. 14, 2008

(86) PCT No.: PCT/JP2008/054724

§ 371 (c)(1),
(2), (4) Date: Mar. 1, 2010

(87) PCT Pub. No.: WO2008/142900

PCT Pub. Date: Nov. 27, 2008

(65) Prior Publication Data

US 2010/0171665 A1 Jul. 8, 2010

(30) Foreign Application Priority Data

May 17, 2007 (JP) ..... P2007-131608

(51) Int. Cl.
*H01Q 1/38* (2006.01)

(52) U.S. Cl. ..... 343/700 MS; 343/824

(58) Field of Classification Search ..... 343/700 MS, 343/893, 824, 825, 826, 827
See application file for complete search history.

(56) References Cited

U.S. PATENT DOCUMENTS

| | | | | |
|---|---|---|---|---|
| 4,543,579 | A * | 9/1985 | Teshirogi | 342/365 |
| 4,907,012 | A | 3/1990 | Trumble | |
| 5,181,042 | A * | 1/1993 | Kaise et al. | 343/700 MS |
| 5,539,421 | A | 7/1996 | Hong | |

FOREIGN PATENT DOCUMENTS

| | | | |
|---|---|---|---|
| JP | 03-151703 | | 6/1991 |
| JP | 04038001 | A * | 2/1992 |
| JP | 07-176950 | | 7/1995 |
| JP | 09-098016 | | 4/1997 |
| WO | WO 2008-142900 | A1 | 11/2008 |

OTHER PUBLICATIONS

Japanese language Search Report for International Application No. PCT/JP2008/054724 (9 pages).

* cited by examiner

*Primary Examiner* — Dieu H Duong
(74) *Attorney, Agent, or Firm* — Foley & Lardner LLP

(57) ABSTRACT

To provide an array antenna which has both excellent directional characteristics and axial ratio characteristics without changing a substrate or dimensions, even when a frequency is changed. A first sequential arrangement section, in which antennas are sequentially arranged from the left end section to the center section, and a second sequential arrangement section, in which antennas are sequentially arranged from the right end section to the center section, are symmetrically arranged.

9 Claims, 14 Drawing Sheets

(a)

(b)

(a)

(b)

(a)

(b)

(a)

(b)

ARRAY ANTENNA

TECHNICAL FIELD

The present invention relates to an array antenna in which a plurality of planar antenna elements with perturbation are linearly arranged.

BACKGROUND ART

Conventionally, an antenna represented by a planar antenna with perturbation has characteristics in having a narrow axial ratio band and maintaining a satisfactory axial ratio near the designed frequency, but in that the axial ratio characteristics significantly degrades when the frequency shifts. This state is shown in FIGS. 15(*a*) and 15(*b*), where FIG. 15(*a*) is a graph showing the axial ratio characteristics, and FIG. 15(*b*) shows a polarization state at the respective frequency. As apparent from the graph, the axial ratio is substantially 0 dB and is satisfactory at the designed frequency, that is, near the center frequency f0, but the axial ratio characteristic significantly degrades at f−, which is shifted to the − side, and at f+, which is shifted to the + side, with respect to the center frequency. In the polarization state, circular polarization is obtained at the center frequency f0, but an elliptical polarization inclined to the left or the right is obtained and the axial ratio is significantly degraded at f− and f+.

A sequential array antenna in which planar antennas with perturbation are sequentially arranged has been developed in recent years (see e.g., paragraph 0027 of Patent Document 1). The sequential array antenna is arranged with a plurality of antenna elements, and is excited with each antenna element rotated by 180/n (n=1, 2, 3, . . . ) and the phase also changed by 180/n (n=1, 2, 3, . . . ). For instance, as shown in FIG. 16, when the sequential array antenna is configured by linearly arranging three antenna elements, each having one power supply point and opposing cutouts (perturbation), each antenna element is arranged after being mechanically rotated according to the following equation $\phi_n=(n-1)\pi/N$ (n: $n^{th}$ antenna element, N: number of antenna elements, N=3 in the case of three antenna elements).

In the sequential array antenna including N elements, a complete circular polarization is radiated irrespective of the polarization of the antenna elements in the broadside direction (direction orthogonal to the arranging direction of the antenna elements) when the rotation of equation $\phi_n=(n-1)\pi/N$ and phase deviation are applied to the $n^{th}$ antenna element, so that satisfactory circular polarization and impedance characteristics can be maintained over a wide band.

However, when using a frequency (communication channel) shifted from the center frequency, the directional characteristics of the sequential array antenna become as shown in FIGS. 17(*a*) to 17(*d*) and a problem in that the directional characteristics change by the frequency arises. In particular, when controlling the directional direction as a phased array antenna in combination with a phase shifter, the beam direction changes by the frequency. This is particularly significant when the communication counterpart is a linear polarization as in RFID, and the reception area tends to change by the frequency. FIGS. 17(*a*) to 17(*d*) show the directional characteristics and the axial ratio characteristics of the sequential array antenna, where FIGS. 17(*a*) and 17(*b*) show the state of the beam when the frequency f+ is used, and FIGS. 17(*c*) and 17(*d*) show the state of the beam when the frequency f− is used. Here, $E_\theta$ is the horizontal component of the circular polarization and $E_\phi$ is the vertical component, where in the cases of frequency f+ and frequency f−, the beam direction is left and right opposite although the gain does not change and the axial ratio characteristics do not change in $E_\theta$ and $E_\phi$, and furthermore, change exists in $E_\theta$ and $E_\phi$ when beam shifted in combination with the phase shifter, as shown in FIGS. 17(*b*) and 17(*d*).

In a case of a general phased array antenna in which antenna elements with perturbation having the same antenna direction are linearly arranged as shown in FIG. 18, the directional characteristics do not depend on the frequency but fluctuation in gain becomes large as shown in FIGS. 19(*a*) to 19(*d*). FIGS. 19(*a*) to 19(*d*) show the directional characteristics of the phased array antenna, where FIGS. 19(*a*) and 19(*b*) show the state of the beam when the frequency f+ is used, and FIGS. 19(*c*) and 19(*d*) show the state of the beam when the frequency f− is used. In the cases of frequency f+ and frequency f−, the gain is opposite although the front direction is being faced and change is not found in the directional characteristics in both $E_\theta$ and $E_\phi$. Similar to the above, change exists in $E_\theta$ and $E_\phi$ when beam shifted.

In other words, if the sequential array antenna or the phased array antenna is configured using a planar antenna element in which the individual antenna axial ratio band is low, the broadside direction maintains satisfactory axial ratio characteristics over a wide band regardless of the change in frequency but the directional direction fluctuates due to change in frequency in the sequential array antenna. In the phased array antenna, the directional direction does not fluctuate due to change in frequency, but the axial ratio fluctuates due to change in frequency. Thus, the respective array antennas have advantages and disadvantages in the directional characteristics and the axial ratio band.

The following method is known as a method for solving the problems of the background art. One method of improving the axial ratio band is a method of thickening the thickness of the substrate that configures the array antenna or lowering the substrate dielectric constant. However, the use of such a method arises other problems in that the size of the antenna becomes large and miniaturization cannot be achieved, the manufacturing cost increases, and the like. Another method of improving the axial ratio band is a method of providing the power supply point at two regions, but such a method also arises a different problem in that the power supply circuit becomes complicating. In addition, a method of increasing the antenna element not only in the horizontal row but also in the vertical row in the sequential array antenna to obtain a so-called sequential sub-array configuration is known, but such a method also arises a different problem in that the size of the antenna becomes large. Therefore, if the above-described problems are solved with the methods of the background art, problems such as enlargement of the antenna size and complication arise, and a satisfying method for solving is not yet proposed.

Patent Document 1: Japanese Unexamined Patent Publication No. 09-98016

DISCLOSURE OF THE INVENTION

Problems to be Solved by the Invention

The present invention has been devised to solve the problems described above, and an object thereof is to provide an array antenna in which a plurality of planar antenna elements with perturbation are linearly arranged, the array antenna having both excellent directional characteristics and axial ratio characteristics without changing a substrate or dimensions even when a frequency is changed.

Means for Solving the Problems

The present invention is directed to an array antenna in which a plurality of planar antenna elements with perturbation are linearly arranged, the array antenna including: a first sequential arrangement section in which antenna elements are sequentially arranged from a left end section to a center section; and a second sequential arrangement section in which antenna elements are sequentially arranged from a right end section to the center section; wherein the first sequential arrangement section and the second sequential arrangement section are symmetric.

The method of applying perturbation to the planar antenna element includes a method of loading a degeneracy separation element by cutout (slit) and the like to a linear polarization patch antenna. The planar antenna generates circular polarization by loading the degeneracy separation element. When referring to "sequentially arranged", this means that the antenna elements are arranged to satisfy $\phi_n=(n-1)\pi/N$ (n: $n^{th}$ antenna element, N: number of antenna elements). When referring to "symmetric", this means a state in which the first sequential arrangement section matches the second sequential arrangement section when rotated 180 degrees and overlapped thereon.

The plurality of planar antenna elements with perturbation may be provided in an even number or an odd number. If including an odd number of antenna elements, the planar antenna element positioned at the center section is commonly used by the first sequential arrangement section and the second sequential arrangement section.

Each of the planar antenna elements with perturbation may be a circular patch antenna or a square patch antenna.

The planar antenna elements with perturbation configuring the first sequential arrangement section and the second sequential arrangement section may be spaced at equal or unequal intervals. The interval of each antenna element may be an equal interval or an unequal interval, but the symmetrical relationship in which the first sequential arrangement section matches the second sequential arrangement section when rotated 180 degrees and overlapped thereon needs to be satisfied.

Effect of the Invention

As described above, according to the present invention, provided is an array antenna in which a plurality of planar antenna elements with perturbation is linearly arranged, the array antenna including a first sequential arrangement section in which the antenna elements are arranged from the left end section to the center section and a second sequential arrangement section in which the antenna elements are arranged from the right end section to the center section, and the first sequential arrangement section and the second sequential arrangement section being symmetric. Both excellent directional characteristics and the axial ratio characteristics are obtained without changing a substrate or dimensions even when a frequency is changed.

DESCRIPTION OF SYMBOLS

S1, S10, S11, S12 First sequential arrangement section
S2, S20, S21, S22 Second sequential arrangement section
10(1), 10(2), . . . , 10(n), 20(1), 20(2), . . . , 20(n) Antenna element
11, 21 Power supply point
12, 22 Cutout (perturbation)

BEST MODE FOR CARRYING OUT THE INVENTION

Hereinafter, embodiments of the present invention will be described in detail with reference to the drawings.

In brief, the arrangement of antenna elements in a conventional sequential array antenna is improved in an array antenna of the present invention based on the following theory so that both the directional characteristics and the axial ratio characteristics are satisfactory even when a usage channel is changed.

The present inventors came to invent the array antenna of the present invention based on the following presumption. This will be described in detail below.

Figure 1:
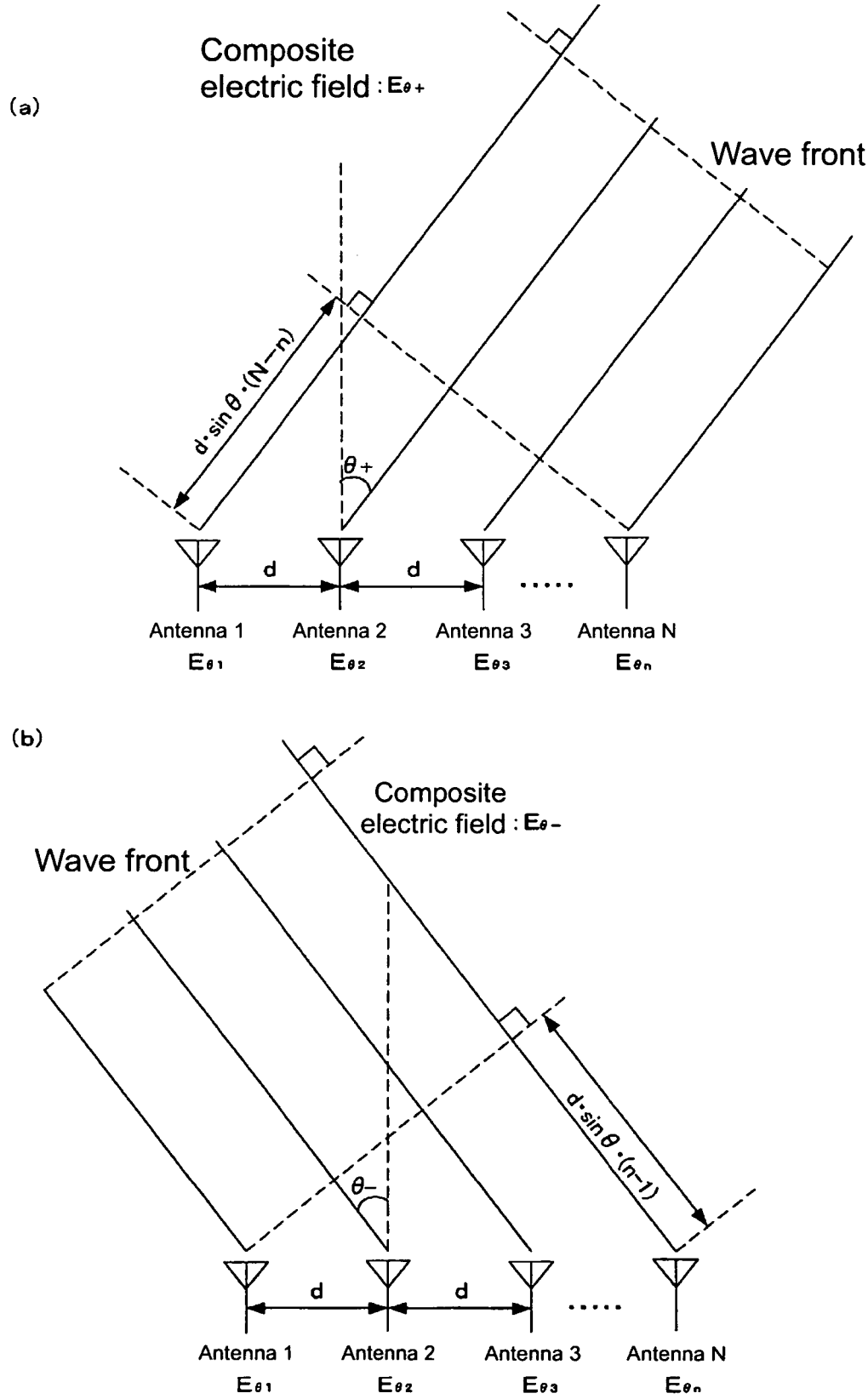
FIGS. 1(*a*) and 1(*b*) are diagrams describing that a directional direction of an array antenna of the present invention is symmetric, where FIG. 1(*a*) shows the directional property on the right side and FIG. 1(*b*) shows the directional property on the left side.

First, as shown in FIGS. 1(*a*) and 1(*b*), there is shown the electric field intensity in a θ+ direction and a θ− direction when a beam is directed in a broadside direction under the following conditions in a array antenna in which a plurality of (N) antenna elements (antenna 1, antenna 2, . . . antenna N) are linearly arranged.

FIG. 1(*a*) shows the electric field in the θ+ direction, and the conditions thereof are as follows. Assume that an excitation amplitude in the θ (Theta) direction of each antenna element is $E_{\theta n}$ (first antenna element is $E_{\theta 1}$), a composite electric field in the θ+ direction is $E_{\theta+}$, a directional gain of each antenna element is D(θ), a number of waves is $k=2\pi/\lambda$, and a spacing of the antenna elements is d. An excitation phase (ϕ) of each antenna element is the same. In this case, a composite electric field $E_{\theta+}$ is expressed with the following <equation 1>.

<Equation 1>

$$E_{\theta+}=D(\theta)\cdot\Sigma E_{\theta n}\{j(\phi+kd\cdot\sin\theta\cdot(N-n))\} \quad [1]$$

Expanding the term of Σ yields:

$$E_{\theta 1}\{j(\phi+kd\cdot\sin\theta\cdot(N-1))\}+E_{\theta 2}\{j(\phi+kd\cdot\sin\theta\cdot(N-2))\}+\ldots+E_{\theta N}(j\phi) \quad [2]$$

FIG. 1(*b*) shows a case in which the beam is directed in the θ− direction, and the conditions thereof are as follows. Assume that an excitation amplitude in the θ (Theta) direction of each antenna element is $E_{\theta n}$ (first antenna element is $E_{\theta 1}$), a composite electric field in the θ− direction is $E_{\theta-}$, a directional gain of each antenna element is D(θ), a number of waves is $k=2\pi/\lambda$, and a spacing of the antenna elements is d. An excitation phase (ϕ) of each antenna element is the same. In this case, a composite electric field $E_{\theta-}$ is expressed with the following <equation 2>.

<Equation 2>

$$E_{\theta-}=D(\theta)\cdot\Sigma E_{\theta n}\{j(\phi+kd\cdot\sin\theta\cdot(n-1))\} \quad [3]$$

Expanding the term of Σ yields:

$$E_{\theta N}\{j(\phi+kd\cdot\sin\theta\cdot(N-1))\}+E_{\theta(n-1)}\{j(\phi+kd\cdot\sin\theta\cdot(N-2))\}+\ldots+E_{\theta 1}(j\phi) \quad [4]$$

In [4], expansion starts from the N term for easy understanding.

The condition of $E_{\theta+}=E_{\theta-}$ needs to be satisfied to obtain a symmetrical beam pattern. In this case, the directional characteristics D(θ) of the individual antenna element is D(θ+)=D(θ−), and thus, equations [2] and [4] need to be equal. In other words, equation [5] below needs to be satisfied.

$$E_{\theta 1}\{j(\phi+kd\cdot\sin\theta\cdot(N-1))\}+E_{\theta 2}\{j(\phi+kd\cdot\sin\theta\cdot(N-2))\}+\ldots+E_{\theta N}(j\phi)=E_{\theta N}\{j(\phi+kd\cdot\sin\theta\cdot(N-1))\}+E_{(\theta n-1)}\{j(\phi+kd\cdot\sin\theta\cdot(N-2))\}+\ldots+E_{(\theta n-1)}(j\phi) \quad [5]$$

Figure 2:
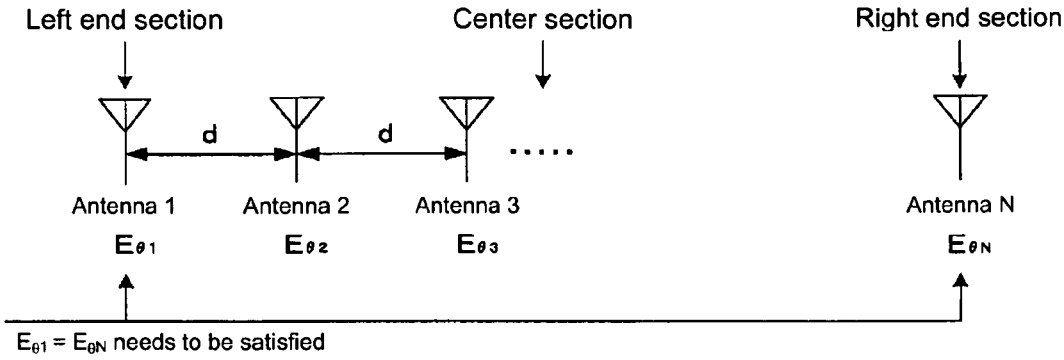
FIG. 2 is a diagram describing that the directional direction of the array antenna of the present invention is symmetric, schematically showing the conditions therefor.

From equation [5], $$E_{\theta 1}=E_{\theta N} \text{ and } E_{\theta 2}=E_{\theta(n-1)} \text{ and} \quad [6]$$

need to be satisfied. That is, $$E_{\theta n}=E_{\theta(N-n+1)} \quad [7]$$

need to be satisfied. The conditional equation [7] is schematically shown in FIG. 2. In this case, the excitation amplitude from the left end section to the center section, and the excitation amplitude from the right end section to the center section are responded in order.

Figure 3:
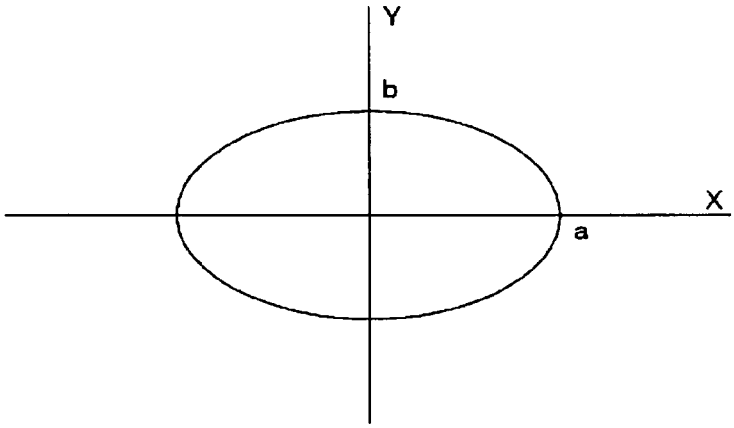
FIGS. 3(*a*) and 3(*b*) are diagrams describing that the directional direction of the array antenna of the present invention is symmetric.
Figure 3:
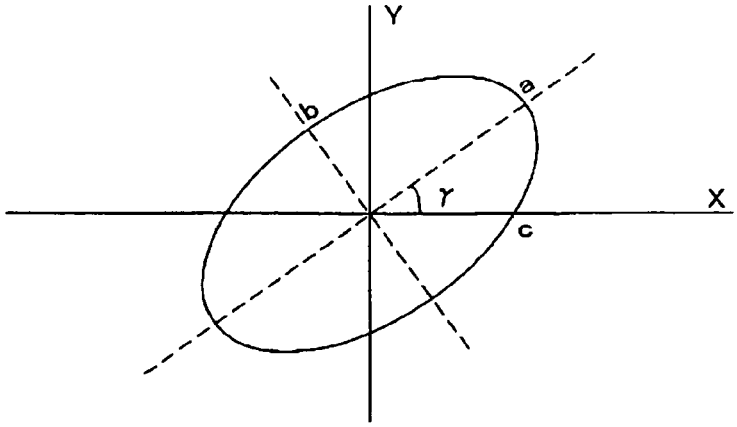

If the axial ratio of each antenna element configuring the array antenna is a:b, as shown in FIG. 3(*a*), the amplitude in the X direction excites a·sin(ωt). If tilted by γ, as shown in FIG. 3(*b*), due to the arrangement of the antenna elements, the amplitude c in the X direction is expressed with the following mathematical formula.

$$c=\sqrt{\{(a\cdot\cos(-\gamma))^2+(b\cdot\sin(-\gamma))^2\}} \quad [8]$$

If each antenna element is sequentially arranged, the arrangement of each antenna element is assumed to satisfy the following conditional equation.

<Conditional Equation>

$\phi_n=(n-1)\pi/N$ (*n*: $n^{th}$ antenna element, *N*: number of antenna elements)

Assuming the arrangement (tilt) of the second antenna element with respect to the first antenna element is Γ, $$\Gamma=\gamma_2-\gamma_1=\pi/N \quad [9]$$

is obtained, the arrangement (tilt) of the $n^{th}$ antenna element is expressed as (n−1)·Γ.

From equation [8], the amplitude in the X direction (Eθ) of the $n^{th}$ antenna element is expressed as $$E_\theta=\sqrt{((a\cdot\cos(\cdot(n-1)\cdot\Gamma))^2+(b\cdot\sin(\cdot(n-1)\cdot\Gamma))^2)}[10],$$

where (N−1)·Γ=0, π, 2π, . . . need to be satisfied, that is, a general formula (N−1)·Γ=m·π (m represents an integral multiple) needs to be satisfied in order to match the amplitudes of the first antenna element and the $N^{th}$ antenna element in equation [10] although $E_{\theta n}=E_{\theta(N-n+1)}$ needs to be satisfied from equation [7]. When such an equation is transformed, Γ=m·π/(N−1) is obtained, which equation does not match equation [9]. Therefore, shift occurs in the directional direction in the conventional sequential arrangement, and the directional direction is not symmetric.

The directional direction is symmetric if each antenna element is arranged in a special sequential arrangement, as will be described below.

In other words, in the array antenna using the special sequential arrangement, the antenna elements are linearly arranged as shown in FIG. 2, and the antenna elements are sequentially arranged from the left end section to the center section, that is, arranged after being mechanically rotated according to the above equation $\phi_n=(n-1)\pi/N$ (n: $n^{th}$ antenna element, N: number of antenna elements), and similarly, the antenna elements are sequentially arranged from the right end section to the center section, so that the direction of the antenna elements is symmetric between the left side and the right side. Such arrangement of the antenna elements is referred to as "special sequential arrangement" in the present invention.

The condition therefor is to satisfy the following equation, $$\gamma 1=\gamma N,\ \gamma 2=\gamma(N-n),\ \gamma 3=\gamma(N-2),\ \ldots,\ \text{that is,}$$

$$\gamma n=\gamma(N-n+1) \qquad [11]$$

From equation [11] and equation [10], $E\theta_1=E\theta_N$, $E\theta_2=E\theta_{(N-1)}$, $E\theta_3=E\theta_{(N-2)}$, . . . is obtained, which equation can be transformed to a general formula of $$E\theta n=E\theta(N-n+1),\ \text{which matches equation [7].}$$

Equation [7] is a conditional equation for obtaining a symmetric beam pattern in the array antenna, and thus a result in that the directional direction is symmetric is obtained by arranging the antenna elements in the special sequential arrangement so as to satisfy equation [11]. This is the same theory in the Eϕ direction, where the condition of equation [7] is always satisfied even when the axial ratio characteristics due to frequency is changed.

The above description demonstrates that the directional direction becomes symmetric and that the directional characteristics are satisfactory when the antenna elements are arranged in the special sequential arrangement in the array antenna.

The improvement of the axial ratio by such special sequential arrangement will now be described below.

Figure 4:
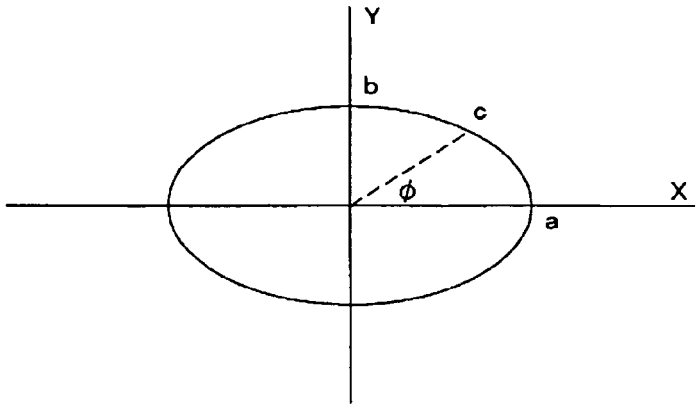
FIG. 4 is a diagram describing that the degradation of the axial ratio improved in the array antenna of the present invention.

First, assuming the axial ratio characteristics of one antenna element is a:b, as shown in FIG. 4, and the amplitude of the angle θ is c in FIG. 4, $$c(\theta)=\sqrt{\{(a\cdot\cos(\phi))^2+(b\cdot\sin(\phi))^2\}} \qquad [12]$$

is obtained. The axial ratio is expressed as E(ϕMAX)=E(ϕMIN) where E(ϕMAX) is the maximum electric field direction and E(ϕMIN) is the minimum electric field direction when the array antenna is configured by such an antenna element. In one antenna element, a:b (ϕ herein is the rotation of ϕ=θ deg in the antenna coordinate system) is obtained.

Figure 5:
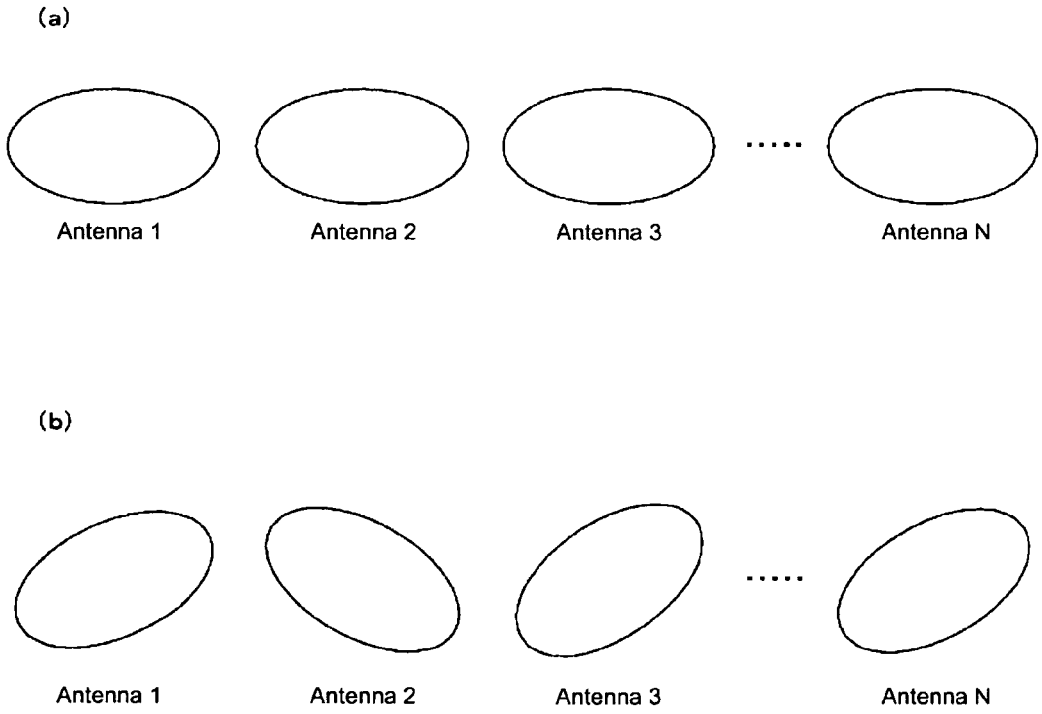
FIGS. 5(*a*) and 5(*b*) are diagrams describing that the degradation of the axial ratio improved in the array antenna of the present invention.

If the polarization of each antenna element is in the state shown in FIG. 5(*a*), the electric field intensity of the angle ϕ of antenna 1 is E1(ϕ), and the electric field intensity of the angle ϕ of antenna n is En(ϕ). If N antenna elements are arranged in the same direction (normal array), the composite electric field E(ϕ) is expressed as below.

$$E(\phi)=\Sigma En(\phi)\ \text{(supplement of } \Sigma\text{: total of } n=1 \text{ to } N)$$

Since E1(ϕ)=E2(ϕ)= . . . =EN(ϕ), then $$E(\phi)=N\cdot E1(\phi)=N\cdot\sqrt{((a\cdot\cos(\phi))^2+(b\cdot\sin(\phi))^2}$$

Therefore, E(ϕMAX)=a·N(ϕ=0°, E(ϕMIN)=b·N(ϕ=90°. The axial ratio of the normal array is thus a:b.

If a certain antenna element is tilted by $\gamma_n$, the polarization of each antenna element becomes the state shown in FIG. 5(*b*). In this case, $$E_n(\theta)=\sqrt{\{(a\cdot\cos(\phi\cdot\gamma_n))^2+(b\cdot\sin(\phi\cdot\gamma_n))^2\}} \qquad [13]$$

is obtained. In the case of the special sequential arrangement, γn=γ(N−n+1) is obtained.

Therefore, the composite electric field in the ϕ direction is $$E(\phi)=E1(\phi)+E2(\phi)+\ldots+EN(\phi) \qquad [14]$$

Here, E(ϕMAX) is obtained when ϕ=γ1 or γ2 or . . . . γN. Here, if the tilt of the center antenna element is γt, γn=γ(N−n+1), and E(γ1)>E(γt) in the case of the special sequential arrangement. Thus, the above equation becomes, excluding γt, E1(γ1)=E2(γ2) . . . EN(γN), where if ϕ=γ1, $$E(\phi\text{MAX}) = E1 + E2 + E3 + \ldots + EN(\phi = y1)$$

$$= a + \sqrt{\{(a\cdot\cos(\gamma 1-\gamma 2))^2 + (b\cdot\sin(\gamma 1-\gamma 2))^2\}} + \ldots + a.$$

(First and last terms are a since first antenna element and $N^{th}$ antenna element have tilt in the same direction)

Furthermore, since γ1−γ2<0 or γ1−γ2>0 and a>b, then $$\sqrt{((a\cdot\cos(\gamma 1-\gamma 2))^2+(b\cdot\sin(\gamma 1-\gamma 2))^2)}<a$$

Therefore, E(ϕMAX)<a·N.

Similarly, E(ϕMIN) is obtained when ϕ=γ1±90° or γ2±90° or . . . γN±90°. If the tilt of the center antenna element is γt, γn=γ(N−n+1), and E(γ1±90)<E(γt±90) in the case of the special sequential arrangement. Thus, the above equation becomes, excluding γt, E1(γ1±90)=E2(γ2±90) . . . EN(γN±90), where if ϕ=γ1±90°, $$E(\phi\text{MIN}) = E1 + E2 + E3 + \ldots + EN(\phi = y1)$$

$$= b + \sqrt{\begin{matrix}\{(a\cdot\cos(\gamma 1 \pm 90-\gamma 2))^2 + \\ (b\cdot\sin(\gamma 1 \pm 90-\gamma 2))^2\}\end{matrix}} + \ldots + b.$$

(First and last terms are b since first element and $N^{th}$ element have tilt in the same direction)

Furthermore, since γ1−γ2<0 or γ1−γ2>0 and a>b, then $\sqrt{\{(a\cdot\cos(\gamma 1\pm 90-\gamma 2))^2+(b\cdot\sin(\gamma 1\pm 90-\gamma 2))^2\}}<b$. Therefore, E(ϕMIN)<b·N.

Therefore, E(ϕMAX):E(ϕMIN)<a:b, whereby degradation of the axial ratio is proven to be reduced by the special sequential arrangement. With such special sequential arrangement, the difference in the directional direction and the degradation of the axial ratio can be improved, in particular, even when the usage frequency is shifted from the center frequency by the usage channel as in the RFID. The array antenna configured by the special sequential arrangement is the array antenna of the present invention.

Figure 6:
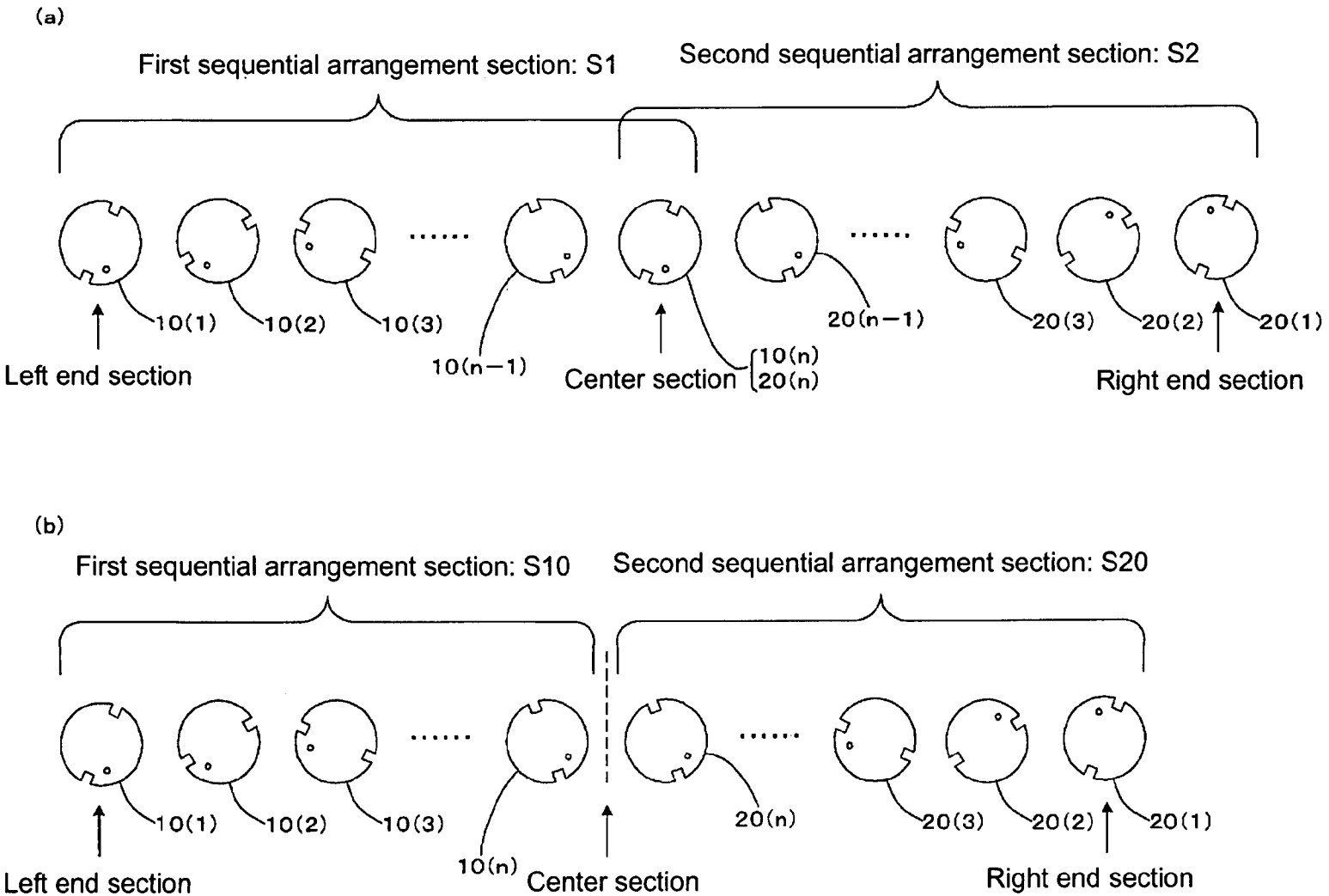
FIGS. 6(*a*) and 6(*b*) are schematic views showing the arrangement structure of the array antenna of the present invention, where FIG. 6(*a*) shows the arrangement for odd number and FIG. 6(*b*) shows the arrangement for even number.

A specific configuration of the array antenna of the present invention will now be described with reference to FIGS. 6(*a*) and 6(*b*). FIGS. 6(*a*) and 6(*b*) are diagrams schematically showing the arrangement structure of the array antenna of the present invention, where FIG. 6(*a*) shows a case in which the number of antenna elements is an odd number and FIG. 6(*b*) shows a case in which the number of antenna elements is an even number.

The array antenna according to one embodiment of the present invention is configured as in FIG. 6(*a*). In other words, the array antenna has a plurality of antenna elements 10(1), 10(2), . . . 20(1), 20(2), . . . that are linearly arranged, where each antenna element is a circular patch antenna having one power supply point 11 or 21, and opposing cutouts 12 or 22 as perturbation. The structure of each antenna element is all the same, and only differs in the antenna direction. The power supply point 11 or 21, and the cutouts 12 or 22 are given a reference number only to the representative portion.

The array antenna includes a first sequential arrangement portion S1 in which a plurality of antenna elements 10(1), 10(2), . . . are sequentially arranged from the left end section to the center section, and a second sequential arrangement section S2 in which a plurality of antenna elements 20(1), 20(2), . . . are sequentially arranged from the right end section to the center section, where the number of the whole antenna elements is an odd number. In this case, the antenna element 10(*n*) or 20(*n*) at the center section shown is commonly used by the first sequential arrangement section S1 and the second sequential arrangement section S2. The first sequential arrangement section S1 and the second sequential arrangement section S2 are in a symmetrical relationship. The symmetrical relationship means a relationship in which the first sequential arrangement section S1 matches the second sequential arrangement section S2 when rotated 180 degrees and overlapped thereon. When referring to sequentially arranging each antenna element, this means that each antenna is arranged after being mechanically rotated to satisfy the equation $\phi_n=(n-1)\pi/N$ (n: $n^{th}$ antenna element, N: number of antenna elements).

As another embodiment, the array antenna of the present invention is configured by an even number of antenna elements, as shown in FIG. 6(*b*), where the structure of each antenna element is similar to the structure of the antenna element shown in FIG. 6(*a*). In this case as well, the array antenna includes a first sequential arrangement portion S10 in which a plurality of antenna elements 10(1), 10(2), . . . are sequentially arranged from the left end section to the center section, and a second sequential arrangement section S20 in which a plurality of antenna elements 20(1), 20(2), . . . are sequentially arranged from the right end section to the center section, where the first sequential arrangement section S10 and the second sequential arrangement section S20 are in a symmetrical relationship, which is similar to the above.

Figure 7:
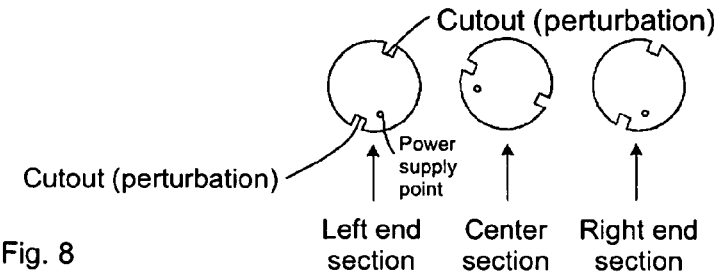
FIG. 7 is a schematic view showing the arrangement structure of the array antenna of the present invention.
Figure 8:
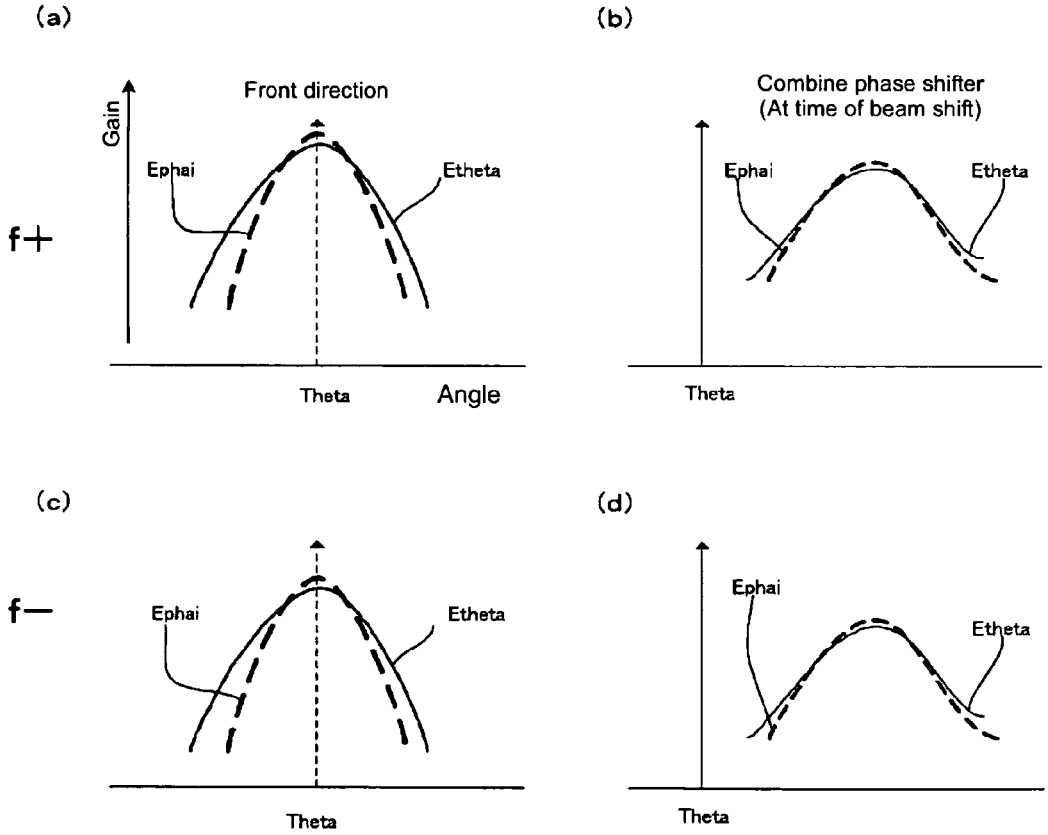
FIGS. 8(*a*) to 8(*d*) are graphs showing the directional characteristics in the array antenna of the present invention shown in FIG. 7.
Figure 17:
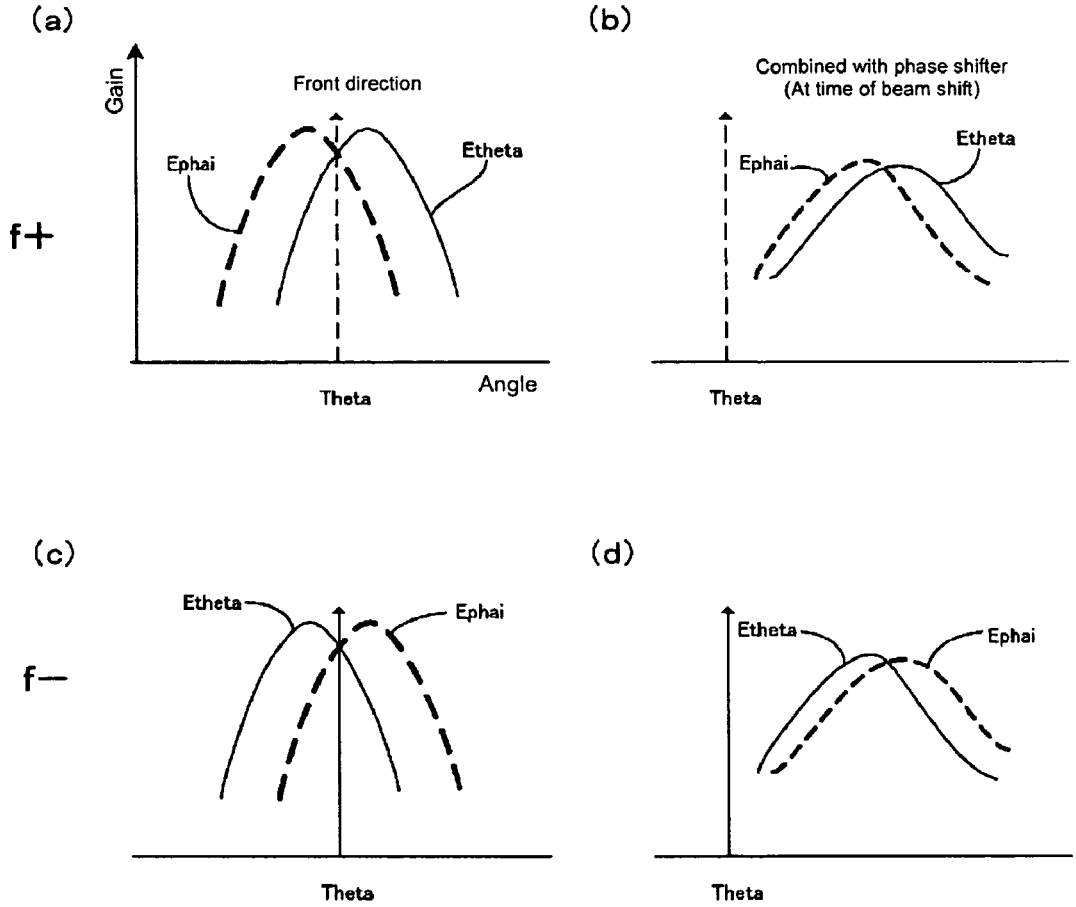
FIGS. 17(*a*) to 17(*d*) are graphs showing fluctuation in the directional characteristics and the gain in the sequential array antenna shown in FIG. 16.
Figure 18:
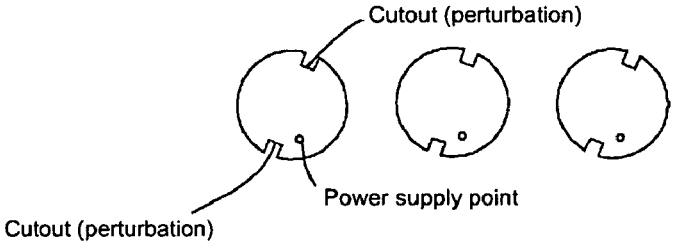
FIG. 18 is an explanatory view showing a configuration of a conventional phased array antenna.
Figure 19:
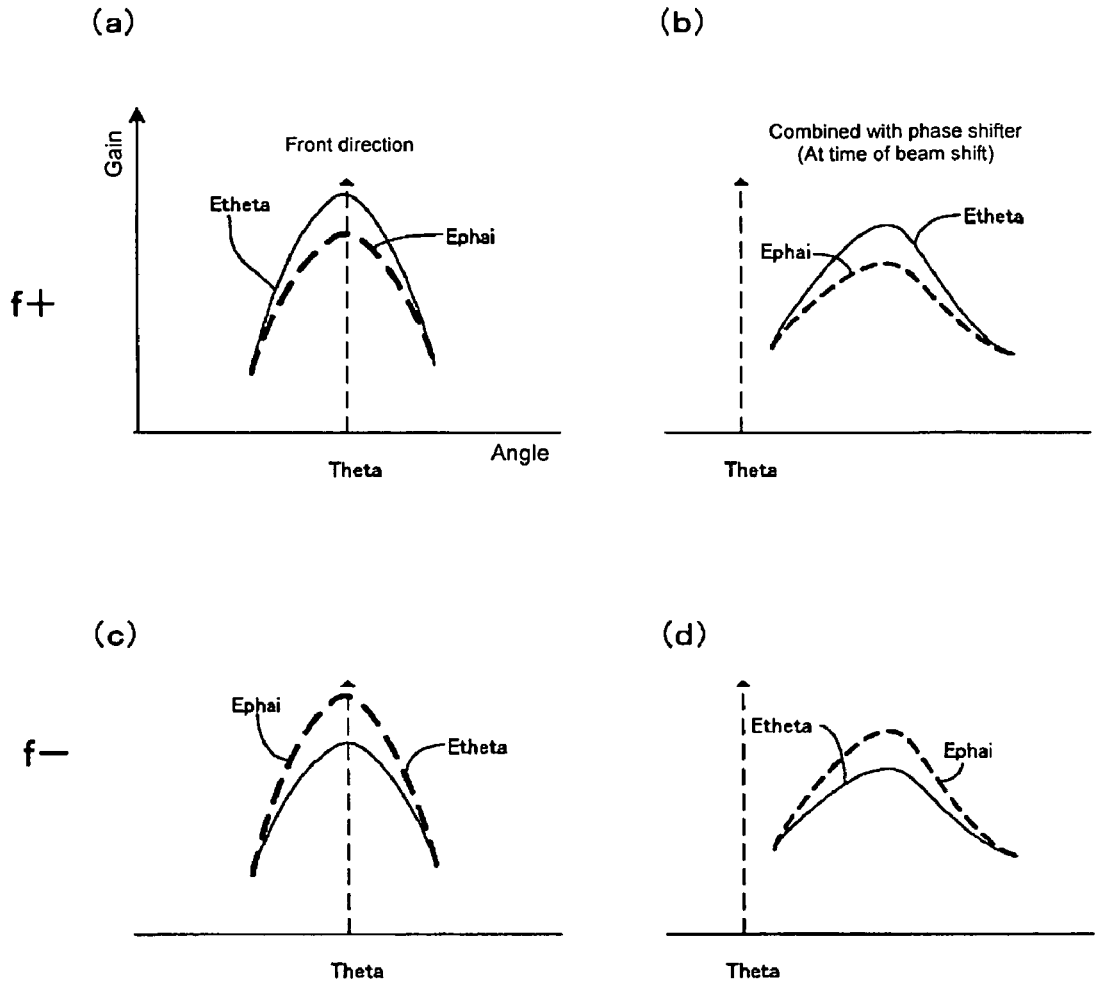
FIGS. 19(*a*) to 19(*d*) are graphs showing fluctuation in the directional characteristics and the gain in the phased array antenna shown in FIG. 18.

In such an array antenna, the directional direction does not fluctuate by the frequency and the axial ratio band also improves when configuring the array antenna by arranging the antenna elements in the special sequential arrangement. For instance, examining the directional characteristics and the axial ratio band when the array antenna of the present invention is configured by arranging three antenna elements in the special sequential arrangement, as shown in FIG. 7, the results are as shown in FIGS. 8(*a*) to 8(*d*). FIGS. 8(*a*) to 8(*d*) correspond to FIGS. 17(*a*) to 17(*d*), and show the directional characteristics of the array antenna of the present invention shown in FIG. 7. As opposed to FIGS. 17(*a*) to 17(*d*), the beam direction is directed substantially the front direction and the directional characteristics does not fluctuate by change in frequency at both the frequency f+ and the frequency f−, as shown in FIGS. 8(*a*) and 8(*c*). The gain also barely changes at frequencies f+, f−, and the axial ratio band is also improved. Even when beam shifted in combination with the phase shifter, the directional direction does not fluctuate by the change in frequency and the axial ratio band is also improved, as shown in FIGS. 8(*b*) and 8(*d*).

Figure 9:
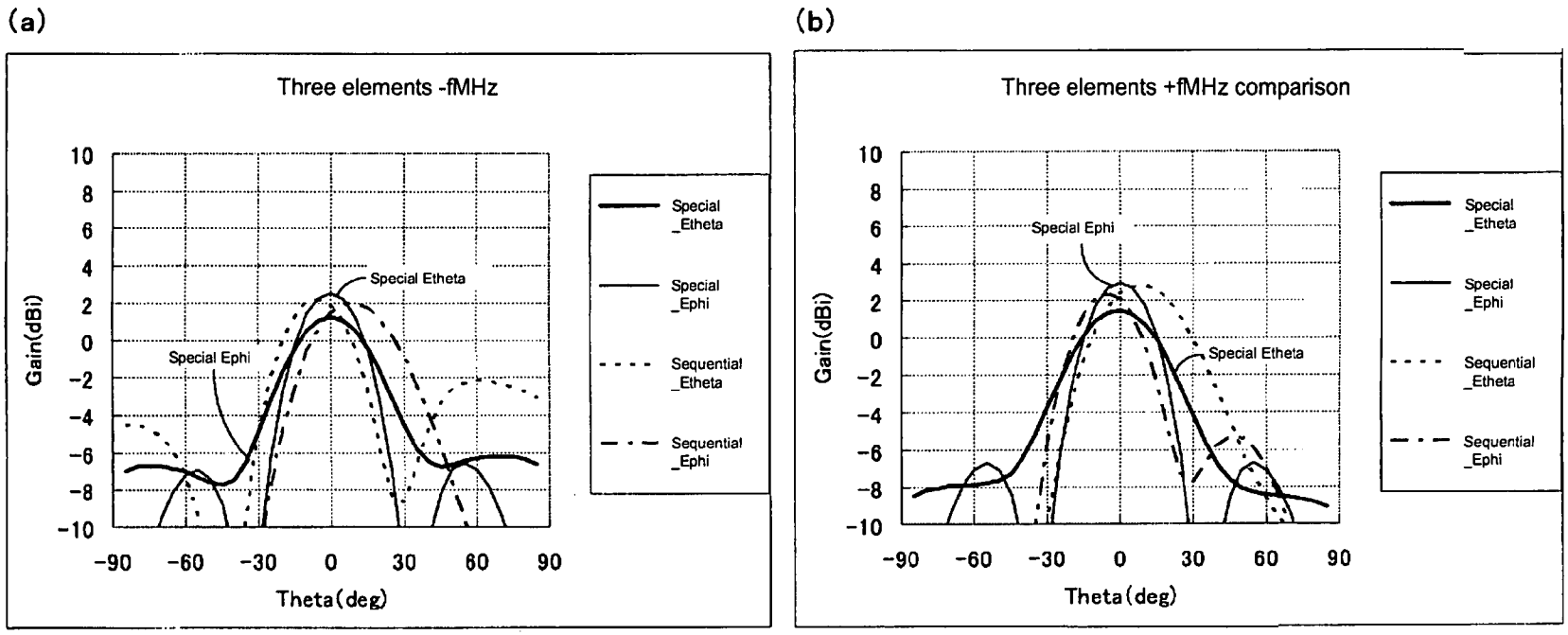
FIGS. 9(*a*) and 9(*b*) are graphs showing the axial ratio characteristics when the array antenna of the present invention is configured by three antenna elements in comparison with the axial ratio characteristics of a conventional sequential array antenna.
Figure 10:
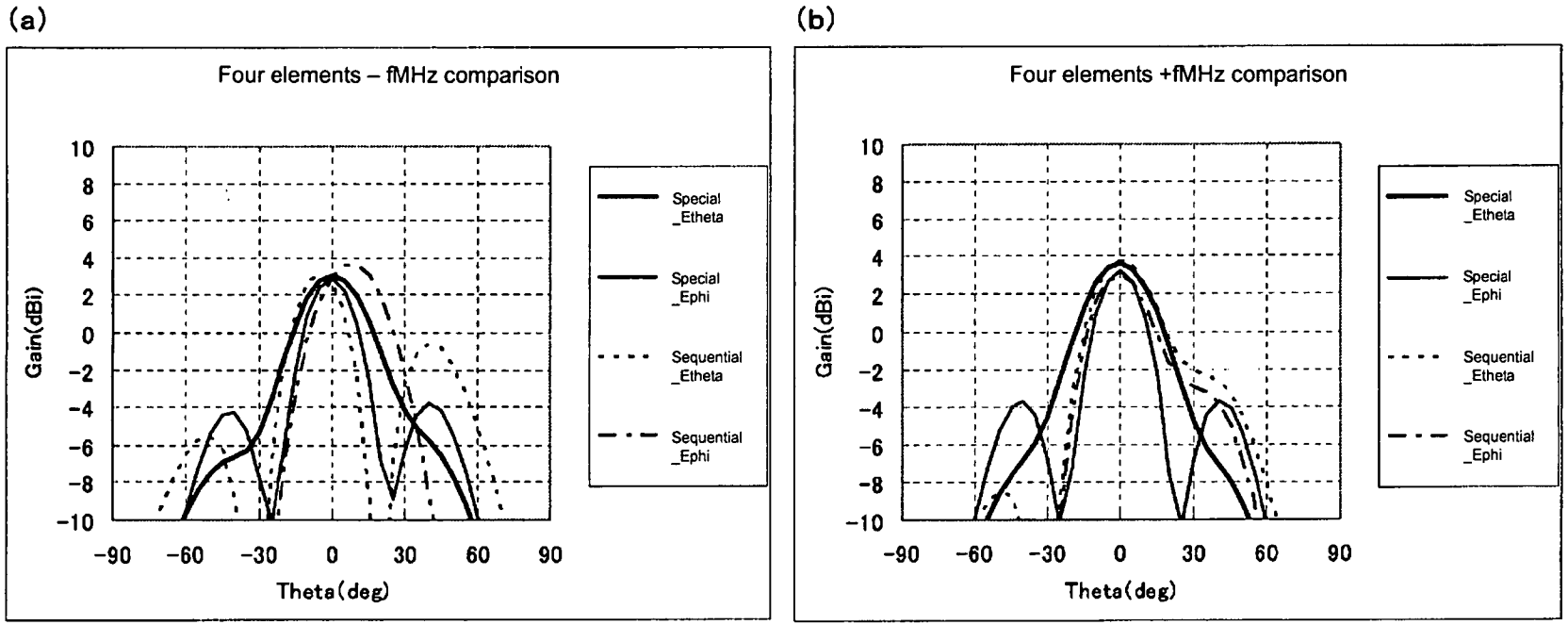
FIGS. 10(*a*) and 10(*b*) are graphs showing the axial ratio characteristics when the array antenna of the present invention is configured by four antenna elements in comparison with the axial ratio characteristics of the conventional sequential array antenna.
Figure 11:
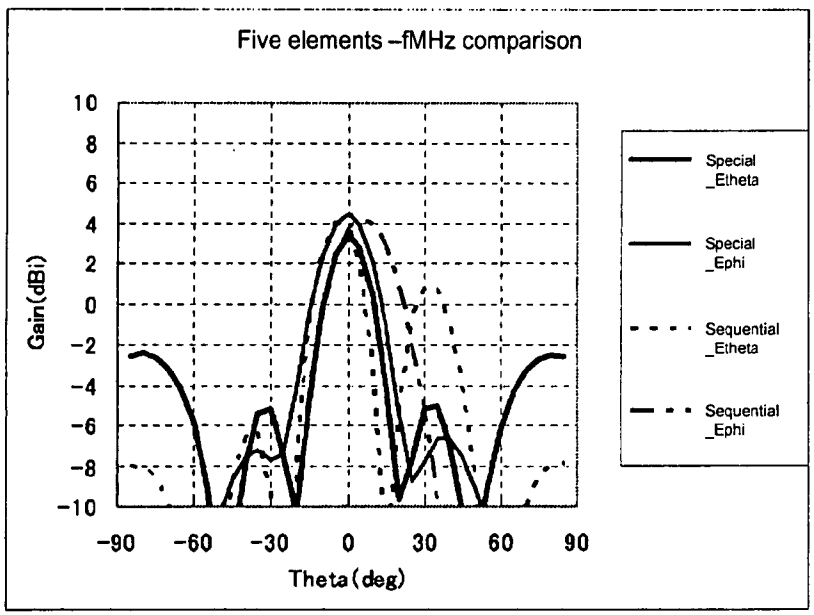
FIGS. 11(*a*) and 11(*b*) are graphs showing the axial ratio characteristics when the array antenna of the present invention is configured by five antenna elements in comparison with the axial ratio characteristics of the conventional sequential array antenna.
Figure 11:
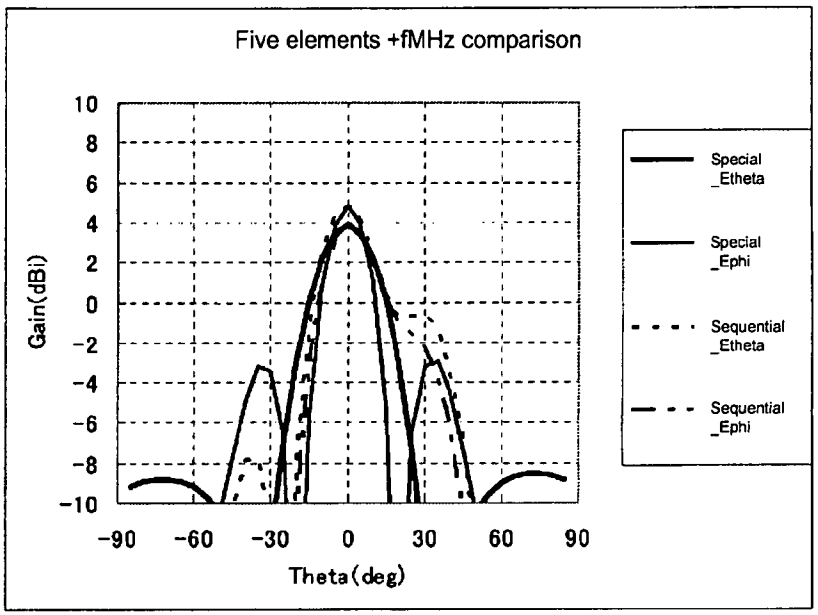
Figure 12:
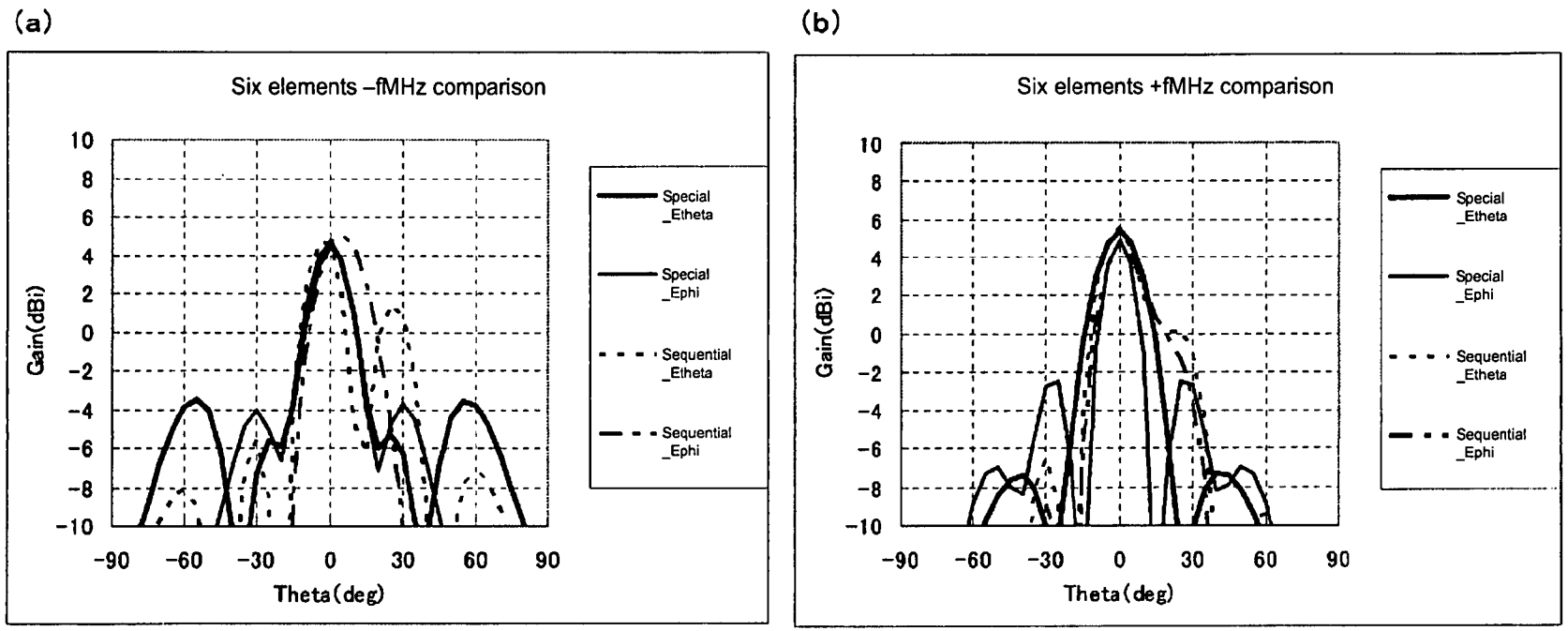
FIGS. 12(*a*) and 12(*b*) are graphs showing the axial ratio characteristics when the array antenna of the present invention is configured by six antenna elements in comparison with the axial ratio characteristics of the conventional sequential array antenna.

Furthermore, the present inventors conducted a comparative experiment for when the antenna elements are arranged in the conventional sequential arrangement and for when arranged in the special sequential arrangement of the present invention, with the number of antenna elements changed between three and six. The results are shown in FIGS. 9(*a*) to 12(*b*). In all figures, the left side is for frequency f− and the right side is for frequency f+, the vertical axis is the gain, and the horizontal axis is the angle. The special Etheta and the special Ephi are for the array antenna of the present invention, and sequential Etheta and the sequential Ephi are for the conventional sequential array antenna. With reference to such figures, non-symmetrical relationship is obtained and the characteristics of the Etheta, Ephi are inverted at +f MHz and −f MHz for the sequential array antenna, but symmetrical relationship is obtained and the axial ratio characteristics is improved compared to the sequential array antenna for the array antenna of the present invention, that is, that in which the antenna elements are arranged in the special sequential arrangement.

Figure 13:
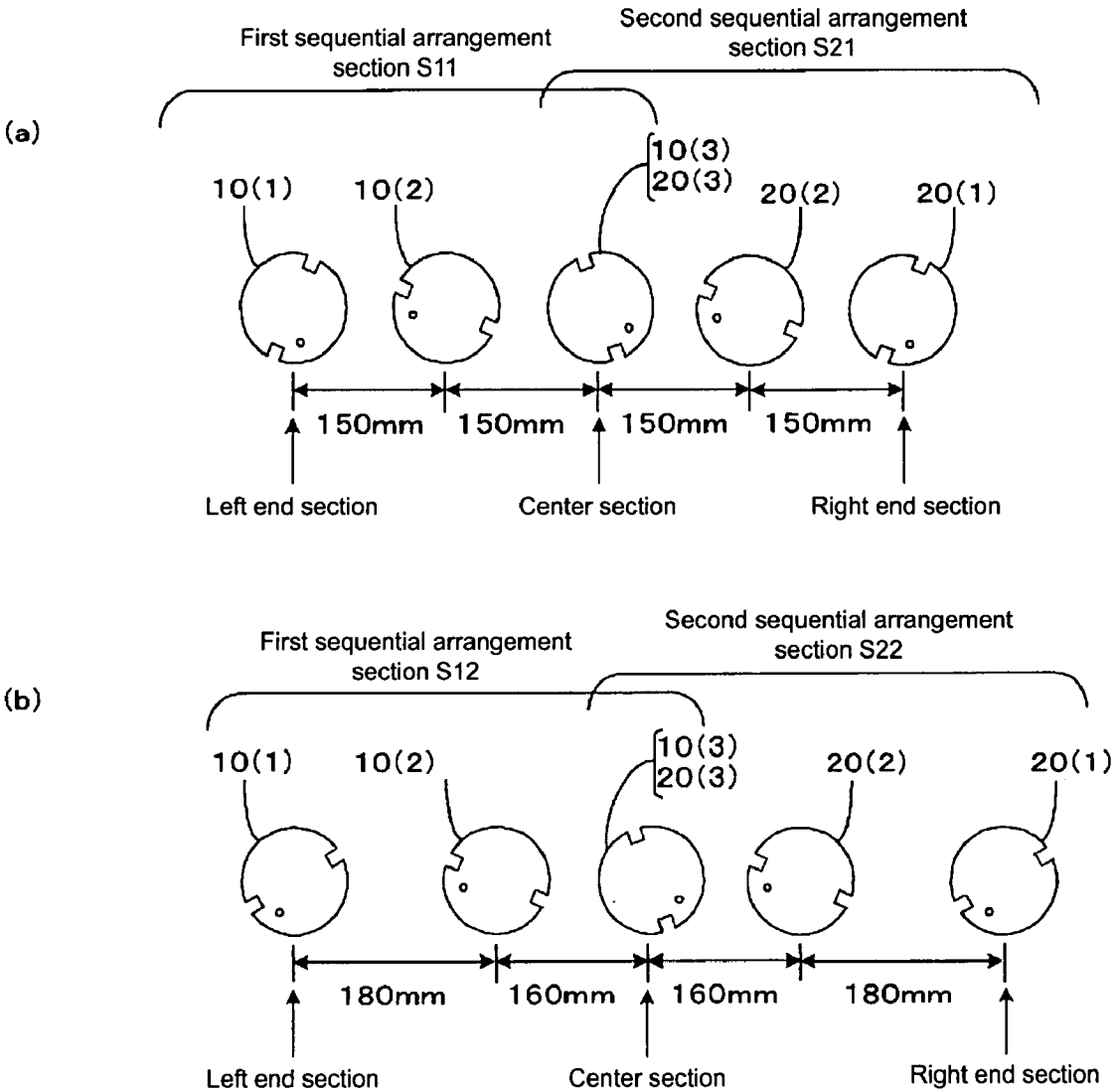
FIGS. 13(*a*) and 13(*b*) are diagrams schematically showing the arrangement of the antenna elements configuring the array antenna of the present invention, where FIG. 13(*a*) shows a case for arrangement at equal intervals and FIG. 13(*b*) shows a case for arrangement at unequal intervals.

The array antenna of the present invention having the above-described configuration has the interval of each antenna element set to an equal interval. The interval of the antenna elements may not necessarily be an equal interval. To prove this, the present inventors performed a simulation while changing the interval of each antenna element. In performing the simulation, the antenna elements were arranged as in FIGS. 13(*a*) and 13(*b*). FIG. 13(*a*) shows a case in which five antenna elements are arranged at equal intervals of 150 mm. FIG. 13(*b*) shows a case in which five antenna elements are arranged at equal intervals of 180 mm between the antenna element 10(1) and the antenna element 10(2) on the left end section and between the antenna element 20(1) and the antenna element 20(2) on the right end section, respectively. The antenna elements are arranged at equal intervals of 160 mm between the antenna element 10(2) and the antenna element 10(3) at the center section and between the antenna element 20(2) and the antenna element 20(3) at the center section, respectively, so that the antenna elements are arranged at uneven intervals as a whole.

In both cases shown in FIGS. 13(*a*) and 13(*b*), the symmetrical relationship needs to be satisfied in which the first sequential arrangement section S11 or S12 matches the second sequential arrangement section 21 or 22 when rotated 180 degrees and overlapped thereon.

Figure 14:
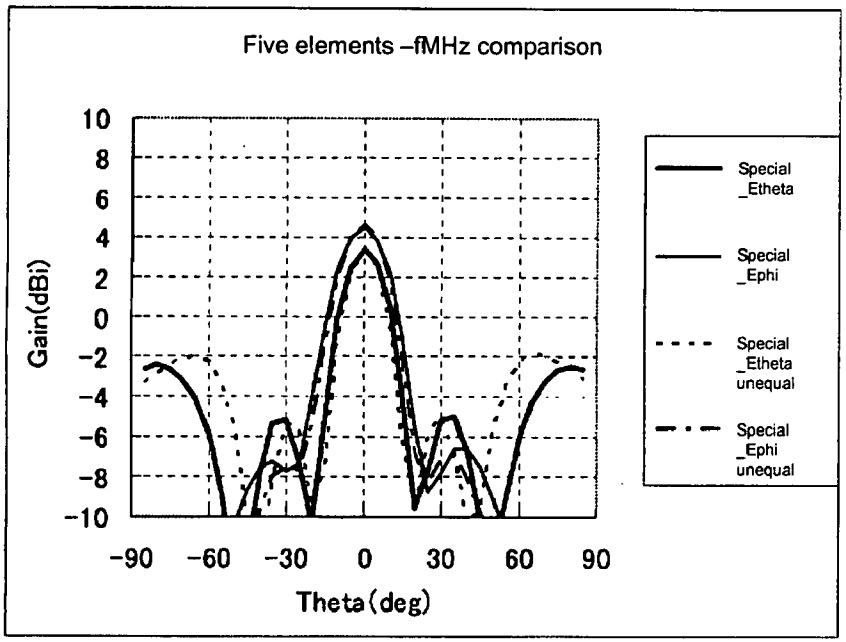
FIGS. 14(*a*) and 14(*b*) are graphs in which the axial ratio characteristics for FIGS. 13(*a*) and 13(*b*) are compared.
Figure 14:
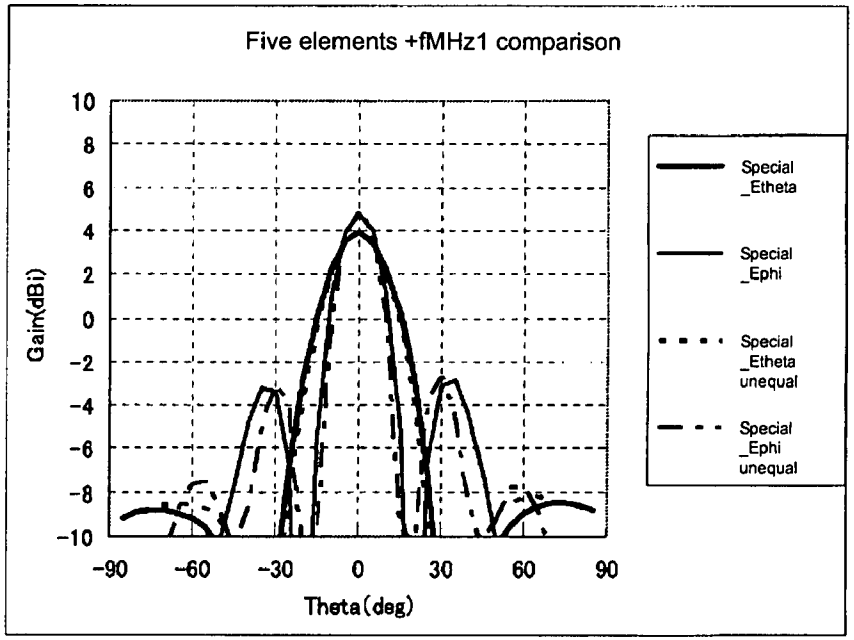
Figure 15:
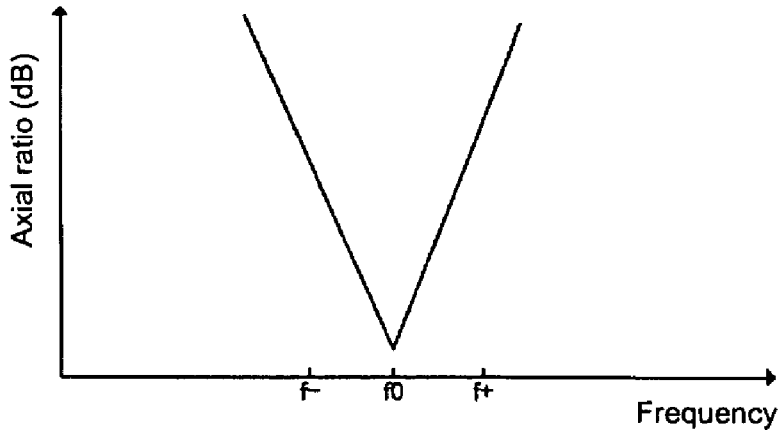
FIGS. 15(*a*) and 15(*b*) are diagrams showing the axial ratio characteristics and the polarization state when a frequency is changed in a conventional planar antenna with perturbation, where FIG. 15(*a*) is a graph showing the axial ratio characteristics, and FIG. 15(*b*) is a diagram showing a polarization state at the respective frequency.
Figure 15:
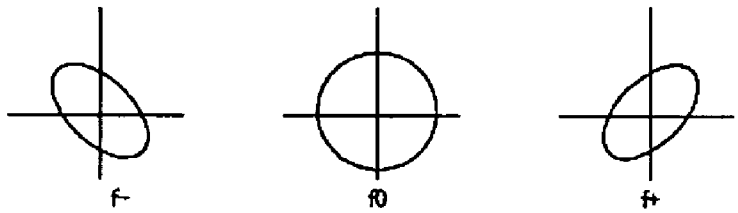
Figure 16:
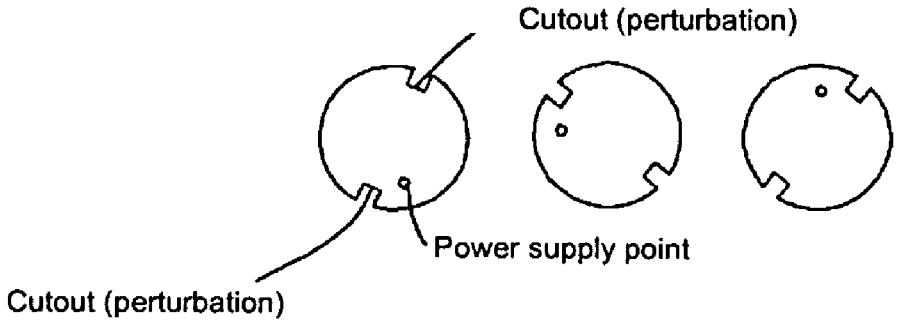
FIG. 16 is an explanatory view showing a configuration of a conventional sequential array antenna.

The simulation results of the array antenna of the present invention configured as in FIGS. 13(*a*) and 13(*b*) are shown in FIGS. 14(*a*) and 14(*b*). Special Etheta and special Ephi are the simulation results of FIG. 13(*a*), and special Etheta unequal and special Ephi unequal are simulation results of FIG. 13(*b*). With reference to such simulation results, it is apparent that the axial ratio characteristics can be improved even if the antenna elements are spaced at unequal intervals.

The invention claimed is:

1. An array antenna in which a plurality of planar antenna elements with perturbation are linearly arranged, the array antenna comprising:

a first sequential arrangement section in which antenna elements are sequentially arranged linearly in one direction from a left end section to a center section such that the rotation angle $\phi_{n1}$ of the perturbation, relative to the rotation angle of the first antenna element of the first sequential section, of each antenna element in the first sequential arrangement satisfies the equation $\phi_{n1}=(n1-1)\pi/N1$, where n1 is the $n^{th}$ antenna element of the first sequential arrangement, and N1 is the total number of antenna elements of the first sequential arrangement; and a second sequential arrangement section in which antenna elements are sequentially arranged linearly in another direction opposite to and collinear with the one direction from a right end section to the center section such that the rotation angle $\phi_{n2}$ of the perturbation, relative to the rotation angle of the first antenna element of the second sequential section, of each antenna element in the second sequential arrangement satisfies the equation $\phi_{n2}=(n2-1)\pi/N2$, where n2 is the $n^{th}$ antenna element of the second sequential arrangement, and N2 is the total number of antenna elements of the second sequential arrangement; wherein the first sequential arrangement section and the second sequential arrangement section are symmetric such that $\phi_{n1}=\phi_{n2}$ for n1=n2.

2. The array antenna according to claim 1, wherein the plurality of planar antenna elements with perturbation are provided in an even number.

3. The array antenna according to claim 1, wherein each of the planar antenna elements with perturbation is a circular patch antenna or a square patch antenna.

4. The array antenna according to claim 3, wherein the planar antenna elements with perturbation configuring the first sequential arrangement section and the second sequential arrangement section are spaced at equal intervals.

5. The array antenna according to claim 3, wherein the planar antenna elements with perturbation configuring the first sequential arrangement section and the second sequential arrangement section are spaced at unequal intervals.

6. The array antenna according to claim 1, wherein the planar antenna elements with perturbation configuring the first sequential arrangement section and the second sequential arrangement section are spaced at equal intervals.

7. The array antenna according to claim 1, wherein the plurality of planar antenna elements with perturbation are provided in an odd number.

8. The array antenna according, to claim 1, wherein the planar antenna elements with perturbation configuring the first sequential arrangement section and the second sequential arrangement section are spaced at unequal intervals,

9. The array antenna according to claim 1, wherein all of the antenna elements of the antenna array are arranged along a single line.

* * * * *